US008365962B2

(12) United States Patent
Canfield

(10) Patent No.: US 8,365,962 B2
(45) Date of Patent: Feb. 5, 2013

(54) LEVER SPRAY PUMP

(75) Inventor: Reiker Canfield, Crystal Lake, IL (US)

(73) Assignee: Aptar Dortmund GmbH, Dortmund (DE)

( * ) Notice: Subject to any disclaimer, the term of this patent is extended or adjusted under 35 U.S.C. 154(b) by 758 days.

(21) Appl. No.: 12/488,929

(22) Filed: Jun. 22, 2009

(65) Prior Publication Data

US 2010/0219207 A1 Sep. 2, 2010

(30) Foreign Application Priority Data

Feb. 27, 2009 (DE) ..... 20 2009 002 773 U
May 18, 2009 (DE) ..... 20 2009 007 139 U

(51) Int. Cl.
*B65D 37/00* (2006.01)

(52) U.S. Cl. ..... 222/153.13; 222/207; 222/481.5

(58) Field of Classification Search ..... 222/153.13, 222/153.14, 207–214, 481.5
See application file for complete search history.

(56) References Cited

U.S. PATENT DOCUMENTS 3,726,442 A 4/1973 Davidson et al.
4,155,487 A * 5/1979 Blake ..... 222/207
4,225,061 A * 9/1980 Blake et al. ..... 222/207
4,260,079 A * 4/1981 Cary et al. ..... 222/209
4,336,895 A * 6/1982 Aleff ..... 222/207
4,506,805 A * 3/1985 Marcon ..... 222/153.13
5,553,752 A * 9/1996 Foster et al. ..... 222/340
5,593,093 A * 1/1997 Foster et al. ..... 239/333
5,603,434 A * 2/1997 von Schuckmann .... 222/153.14
5,615,835 A * 4/1997 Nelson ..... 239/333
5,738,251 A * 4/1998 Schuckmann ..... 222/153.14
2008/0251538 A1 10/2008 Carta
2009/0173751 A1 7/2009 Laidler et al.

FOREIGN PATENT DOCUMENTS

DE 202006011682 U1 11/2006
EP 1568417 8/2005
EP 1661822 B1 10/2008
GB 2211251 6/1989
WO WO 2007/140995 A1 12/2007

* cited by examiner

*Primary Examiner* — Kevin P Shaver
*Assistant Examiner* — Donnell Long
(74) *Attorney, Agent, or Firm* — Jason H. Vick; Sheridan Ross, PC

(57) ABSTRACT

What is being proposed is a lever spray pump for dispensing a cosmetic liquid. The lever spray pump has a flexible section which can be deformed for the pumping of the liquid. The pump has a manually operable actuation element in order to deform the section for pumping. The pump has an air valve for a container associated with the pump. The air valve is embodied in a single piece with the section and is opened automatically upon deformation of the section or operation of the pump. Preferably, the section is pretensioned in the built-in state with non-actuated pump.

17 Claims, 4 Drawing Sheets

LEVER SPRAY PUMP

CROSS REFERENCE TO RELATED APPLICATIONS

This Application claims the benefit under 35 U.S.C. 111(a) to German Application No. DE 202009002773.2 filed Feb. 27, 2009 and German Application No. DE202009007139.1 filed May 18, 2009, the entire disclosures of each of which are incorporated herein by reference in their entirety.

The present invention relates to a pump for the dispensing of a preferably cosmetic liquid with an elastic or flexible section which can be deformed for the pumping of liquid.

In the present invention, the term "pump" is to be understood particularly as a trigger or lever pump, dosing pump and/or hand-operated pump, preferably for the spray-dispensing of a preferably cosmetic liquid.

The term "liquid" is also to be understood preferably as suspensions and other fluids, optionally with gas phases. The liquid can be output as a stream or foam or the like. Preferably, the dispensing of the liquid occurs as a spray mist, i.e. the present invention particularly relates to a spray pump.

The term "cosmetic liquid" is to be understood, in a narrower sense, as cosmetics, hair spray, hair lacquer, deodorants, color sprays, sun protection or skin care agents, generally beauty care agents or the like. Preferably, however, in a broader sense, other body and hair care products are included as well.

For example, the liquid can also be a cleaning agents, lubricants or other products, for example air fresheners, and particularly technical liquids and fluids as well such as rust removers and the like. Nonetheless, for the sake of simplicity and due to the emphasized use, there is often only mention of cosmetic liquid in the following.

DE 20 2006 011 682 U1 discloses a dispensing device in the form of a pump with a lower part and an elastic upper part. The upper part forms a pump chamber with the lower part.

Through the deformation of a flexible section of the upper part, the liquid can be pushed out and dispensed from the pump chamber.

It is the object of the present invention to provide an improved pump wherein simple operation and effective pumping of a particularly cosmetic liquid are achievable and/or a simple, cost-effective construction is made possible.

The above object is achieved through a dispensing device according to claim 1. Advantageous modifications are the subject of the subclaims.

One aspect of the present invention consists in the fact that the elastically deformable section is already pretensioned when the pump is not actuated. This allows for an optimal return to the initial position, particularly without additional return element for the returning of the actuation element into the unactuated state and/or a forceful intake stroke of the pump. This permits a simple and cost-effective construction of the pump with optimal function.

Another aspect of the present invention is that the pump has a manually operable actuation element in order to deform the section for pumping. In particular, the actuation element is embodied in the manner of a lever and/or is swivelable. This permits a simple and cost-effective construction of the pump with optimal function.

Another aspect of the present invention is that the pump has a ventilation valve for a container associated with the pump. Especially preferably, the ventilation valve is opened automatically or by force when the pump or its actuation element is actuated and/or the section for the pumping of liquid is deformed. This permits a simple and cost-effective construction of the pump with optimal function.

Another aspect of the present invention is that the pump is constructed from fewer than ten components, preferably from five components at most. Particularly, the pump is constructed from only an actuation element, a lower part for the mounting of the actuation element, an upper part forming the section, a nozzle insert and/or a suction hose. This permits a simple and cost-effective construction of the pump with optimal function.

Another aspect of the present invention is that the pump is preferably manufactured exclusively from plastic, preferably only from injection-molded parts. This permits a simple and cost-effective construction of the pump with optimal function.

The abovementioned aspects and all other aspects and features resulting from the claims and the following description can be implemented independently of each other and in any combination.

BRIEF DESCRIPTION OF THE DRAWINGS

Further advantages, features, characteristics and aspects of the present invention follow from the claims and the following description of a preferred embodiment on the basis of the drawing.

In the figures, the same reference symbols are used for the same parts even if a repeated description is omitted.

DETAILED DESCRIPTION OF THE INVENTION

Figure 1:
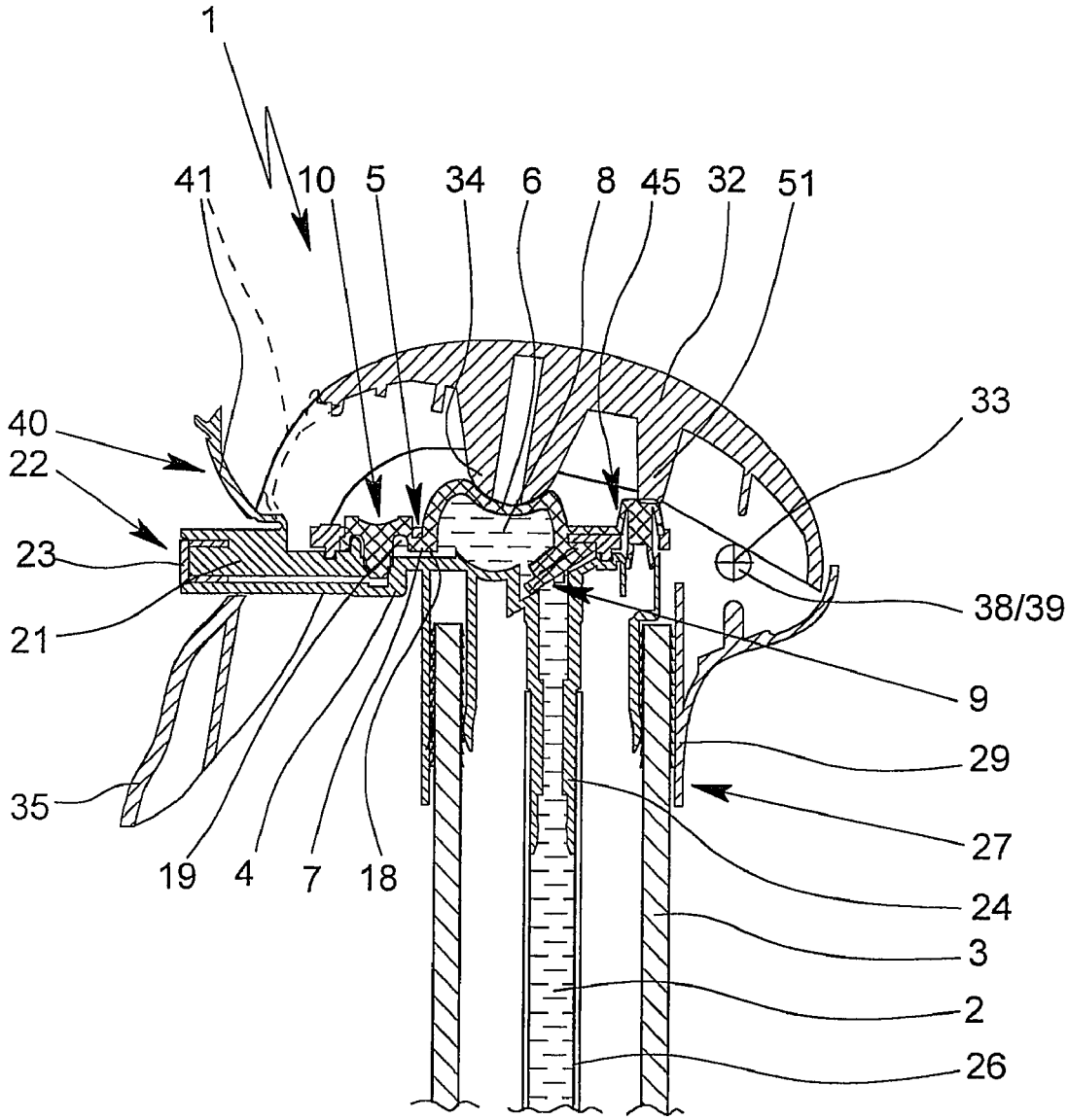
FIG. 1 shows a schematic section of a proposed pump with an only partially depicted container and suction hose.

FIG. 1 shows a proposed pump 1 for dispensing a preferably cosmetic liquid 2 in the sense mentioned at the outset.

A container 3 for supplying the liquid 2 is preferably associated with the pump 1, with said container 3 being detachably connected as needed to the dispensing device 1 or vice-versa. In this way, a changing-out of the container 3 and/or a refilling of the liquid 2 can optionally be performed. Alternatively, the pump 1 can also itself form a reservoir for the liquid 2 or the container 3 or the pump 1 can be fixed or undetachably joined or joinable with the container 3.

The dispensing device 1 preferably has a first component 4, particularly a lower part, and a second component 5, particularly upper part. The second component 5 is preferably joined with the first component 4 preferably in an undetachable, liquid-tight and, particularly, gas-tight manner.

In the description, the terms "lower part" and "upper part" correspond to the preferred arrangement or orientation of the dispensing device 1 during normal use. However, this is not necessarily the case. Accordingly, the lower part and the upper part can also be oriented in any spatial relationship to each other depending on the requirement, application, design and the like.

The first component 4 is preferably rigid and/or a single piece and is particularly injection-molded and/or manufacture in another manner from an appropriate, preferably food-safe plastic, particularly a polyolefin such as PP (polypropylene) or PE (polyethylene).

The second component 5 has or forms a flexible, elastically deformable section 6 for pumping the liquid 2.

In particular, the section 6 has an edge 7 which preferably extends crossways to the primary direction of deformation of the section 6 (which runs substantially downward in FIG. 1) and/or preferably parallel to the primary extension plane of the preferably substantially flat second component 5. The deformable section (pump section) 6 and its optimal edge 7 are preferably manufactured, particularly injection-molded, particularly in a single piece from an appropriately elastically deformable material or plastic, hereinafter also called soft plastic.

In the depicted example, a preferably rigid or plate-like section 14 or the second component 5 is injection-molded onto the section 6 or edge 7 or another connection area or vice-verse, or otherwise joined therewith in an undetachable and, particularly, liquid-tight manner. This makes simple manufacture possible, particularly by means of so-called "bi-injection," which is to say particularly injection of another material in the same injection mold in which a first material is shaped or injected. In particular, a solid chemical and/or mechanical connection is made possible in this way.

Alternatively or in addition, the rigid section 14 is also joined or held with the section 6 or edge 7 or another connection area by an undercut, recess, opening, overlapping or the like.

The section 6 is preferably elastically deformable and/or at least substantially hemispherical, calotte-like, dome-like or arched.

Especially preferably, a receiving or pump chamber 8 for the liquid 2 is formed between the first component 4 and the section 6 or bordered thereby a least in part.

The pump 1 preferably has an inlet valve 9 and an outlet valve 10. Preferably, the second component 5 forms the inlet valve 9 and/or outlet valve 10 together with the first component 4. However, the valves 9, 10 can also be formed separately in principle.

The valves 9, 10 are preferably embodied as self-closing or automatically closing one-way valves which are particularly elastically pretensioned in the closed position.

In the depicted example, the inlet valve 9 has a particularly elastically deformable or held or flexible, preferably tongue-like valve flap 11 which selectively releases or seals an opening 12—particularly an inlet to the pump chamber 8—and is preferably pretensioned in the closed position. Moreover, the inlet valve 9 optionally has a particularly elastically deformable or held or flexible pretensioning element 13 which abuts on the side of the valve flap 11 facing away from the opening 12 and pretensions said valve flap 11 into the closed position.

The valve flap 11 and the pretensioning element 13 are arranged, particularly shaped or injection-molded, on the edge 7 of the section 6 or formed in a single piece therewith. By virtue of this lateral arrangement, an at least extensive or even complete decoupling of the inlet valve 9 from a deformation of the section 6 can be achieved. The valve flap 11 and the pretensioning element 13 can therefore move, deform, be deflected or the like at least to a great extent independently of the deformation state of the section 6. In this way, a more defined closing behavior and/or opening behavior of the inlet valve 9 can be achieved.

FIG. 1 shows the section 6 in the non-depressed state, i.e. with non-actuated pump. The depressed state of the section 6 is indicated with broken lines.

Figure 2:
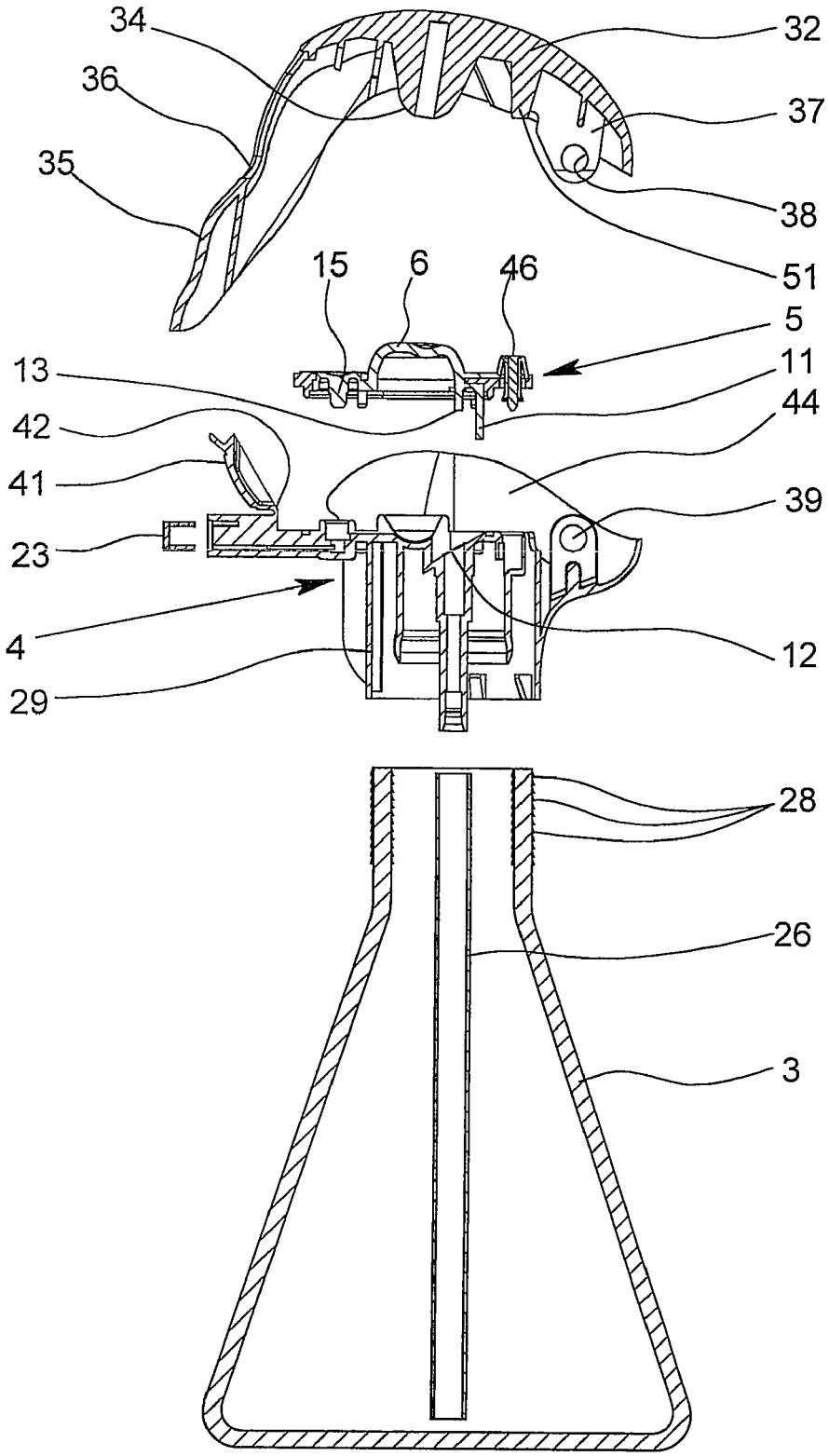
FIG. 2 shows a schematic, exploded sectional representation of the pump.

FIG. 2 shows the pump 1 in a schematic, exploded sectional view. In the unassembled state, it is clear how the valve flap 11 and the optional pretensioning element 13 protrude downward in the manufactured state, for example, from the second component 5 or upper part. Upon assembling the pump 1 or connection of the second component 5 (upper part) with the first component 4 (lower part), the valve flap 11 is pressed against the inlet opening 12, as a result of which the valve flap 11 and the pretensioning element 13 are elastically deformed and a desired pretensioning against the inlet opening 12 is achieved.

Figure 3:
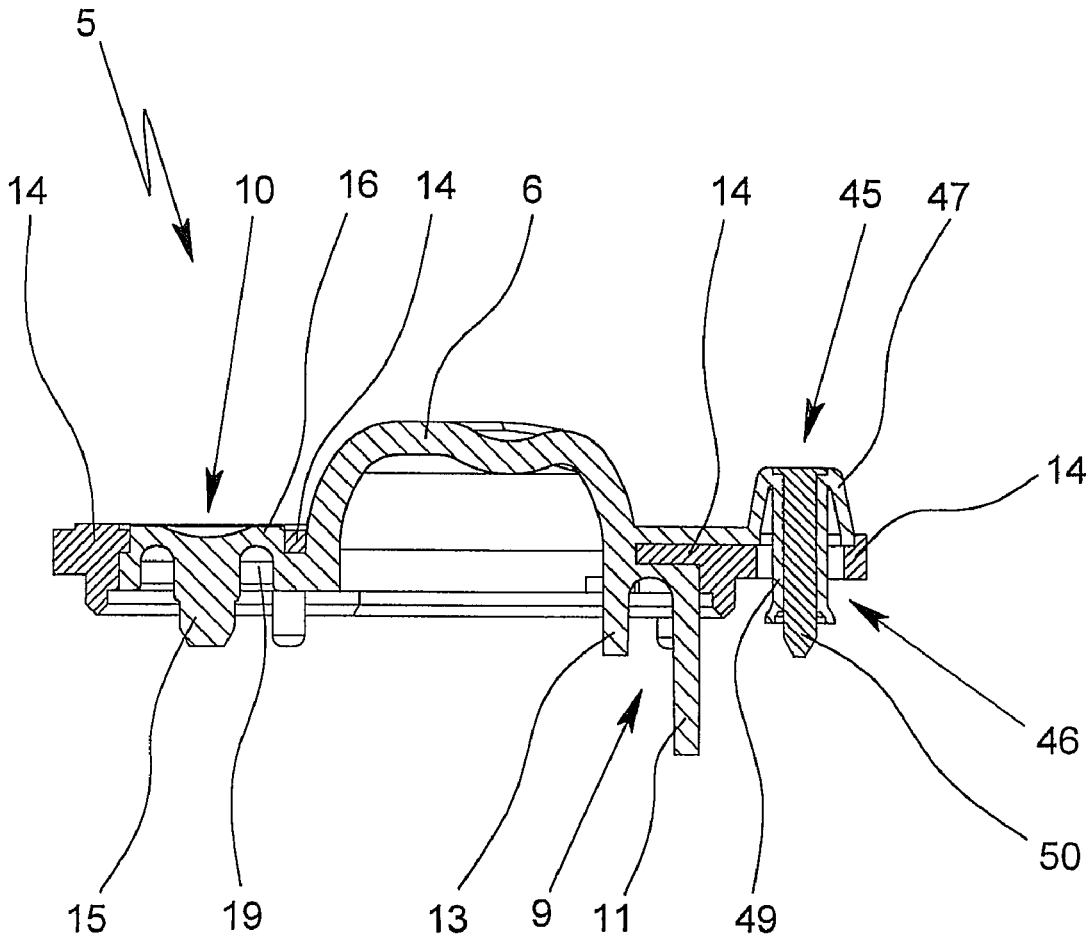
FIG. 3 shows a schematic section of an upper part of the pump.

FIG. 3 shows, in an enlarged schematic section, the upper part or second component 5. Through the varying shading, it is particularly easy to see the preferably rigid section 14 and the comparatively soft or flexible material—that is, the soft plastic—from which the section 6 and preferably the edge 7, the valve flap 11, the pretensioning element 13 and, particularly, other parts as well which shall be dealt with below in further detail are formed especially preferably through formation in one piece and/or injection-molding and/or shaping.

The aforementioned other or molded parts preferably form the outlet valve 10—in the depicted example an outlet valve body 15 and preferably an associated retaining section 16—which preferably keeps the outlet valve body 15 movable or slidable. For this purpose, the retaining section 16 is particularly elastically deformable and/or ring-shaped. However, other constructive solutions are also possible.

To form the outlet valve 10, the outlet valve body 15 preferably works together with an outlet valve seat 17 formed by the first component 4 or lower part as indicated preferably in FIG. 1. The outlet valve seat 17 is preferably formed by a ring-shaped collar, an axial end of a cylinder bore, a conical section or the like.

The outlet valve 10 is preferably connected with the pump chamber 8 via a connection channel 18. In particular, a ring channel 19 is formed around the outlet valve body 15 and/or between the retaining section 16 and the outlet valve seat 17 into which the connection channel 18 empties.

In the depicted example, the connection channel 18 and/or ring channel 19 is/are preferably formed in or by the second component 5 or upper part, especially preferably by the rigid section 14 and/or through covering by the edge 7 and/or other parts or areas made of the soft plastic. Especially preferably, the section 6 and the outlet valve body 15 and/or retaining section 16 are manufactured in a single piece and/or from the same material or are embodied as a single injection-molded part.

In the depicted example, the edge 7 forms, for example, a partial covering of a groove formed in the rigid section 14 in order to form the connection channel 18. The retaining section 16 is preferably molded directly onto the edge 7 or embodied in a single piece therewith. The outlet valve body 15 is preferably embodied in a single piece with the retaining section 16 or is molded onto or formed by it. Especially preferably, the outlet valve body 15 is at least substantially pin-shaped, plate-shaped, cylindrical and/or conical. However, other constructive solutions are also possible.

On the outflow or outlet side, an outlet channel 20 is preferably connected to the outlet valve 10 which, in the depicted example, is preferably formed by or in the first component 4 or lower part. However, other constructive solutions are also possible.

The pump 1 preferably has a particularly trunk-like or protruding outlet area 21 into which the outlet channel 20 extends.

A nozzle 22 is preferably formed at the free end of the outlet area 21. The nozzle 22 is particularly realized by inserting, especially preferably in a clamping manner, a nozzle insert 23 into the outlet channel 20 forming a corresponding receiving area. However, other constructive solutions are also possible. In particular, the optionally provided nozzle 22 can also be mounted in another manner on the pump 1 or on the first and/or second component 4, 5 or be fluidly connected with the outlet valve 10 or outlet channel 20.

The nozzle 22 is especially preferably embodied for the spraying dispensing of the liquid 2, particularly such that a spray mist (not shown) is generated upon dispensing. However, in principle or optionally, the liquid 2 can also be dispensed in the form of a spray stream such as a flat stream or edge jet.

On the inlet side, a connector 24 is preferably connected to the inlet valve 9 or the inlet opening 12 in the depicted example.

The first component 4 or lower part preferably forms the inlet opening 12 or a valve seat of the inlet valve 9 (here for the valve flap 11), the connector 24 and/or a bottom section 25 of the pump chamber 8. In particular, the connector 24 is molded on in a single piece or embodied with the first component 4.

The pump 1 preferably has a suction line 26, here a hose or the like, in order to suck liquid 2 from the container 3. The suction line 26 or the hose is preferably fitted onto the connector 24. However, other constructive solutions are also possible here.

The upper part and the lower part or the components 5 and 4 are joined with each other especially preferably through ultrasound welding and/or in another manner such that the pump chamber 8 and the fluid connection of the outlet valve 10 are liquid-tight and sufficiently gas-tight as well.

In the depicted example, the pump chamber 8 is directly adjacent to the inlet valve 9. This is preferred in order to minimize the dead volume. However, other constructive solutions are also possible here. For example, a connection channel or the like can also be arranged between the inlet valve 9 and the pump chamber 8.

The pump 1 or the first component 4 or lower part preferably has a connection device 27 for the container 3. Especially preferably, the pump 1 or the connection device 27 is embodied such that the container 3 can be connected with the pump 1 or the lower part 4 in a locking and/or screwing manner. Particularly, the container 3 can be connected with the pump 1 or the connection device 27 in a clamping, positive and/or frictional manner.

The connection device 27 is preferably embodied such that a thickened and/or undercut edge or collar 28 or several collars of the container 3 arranged axially one behind the other can be received or mounted in a clamping and/or locking and/or positive manner. In the depicted example, the connection device 27 preferably has an outer cylinder section 29 and, optimally, at least one retaining area 30 arranged in a radially spaced manner within the cylinder section 29 so that the container can be introduced with a connector or its edge/collar 28 into the annular space formed between the cylinder section 29 and the retaining area 30.

Preferably, the connection device 27 has at least one, preferably severally radial projections 31 which point inward and/or outward and are particularly formed on or at the cylinder section 29 or retaining area 30 in order to hold, in the axial direction and in a clamping, locking and/or positive manner, the container 3 or its preferably several ring collars 28 which are arranged axially one after the other such that the container 3 cannot be pulled axially off of the pump 1 or connection device 27 or at least only with very great force, particularly only with forces of greater than 100 N or 200 N.

Especially preferably, at least one inwardly pointing projection on the cylinder section 29 on the one hand is axially shifted here with respect to at least one projection 31 on the other hand formed on the retaining area 30 and pointing outward. In the depicted example, the projection 31 on the retaining area 30 is preferably formed by a circumferential collar or the like.

In the depicted example, the retaining area 30 is preferably likewise cylindrical or circumferential. However, other constructive solutions are also possible here.

FIG. 1 preferably has an actuation element 32 which is embodied here particularly as a lever (often also referred to as a trigger). The actuation element 32 can preferably be operated manually in order to deform the section 6 for the pumping of liquid 2. In particular, the actuation element 32 can be depressed and/or swiveled for this purpose. Especially preferably, to actuate the pump 1 or to pump, the actuation element 32 can be swiveled about a fixed swivel axis 33 which is indicated schematically in FIG. 1 and runs perpendicularly to the drawing plane here in the present representation. However, other constructive solutions are also possible.

The actuation element 32 preferably acts directly on the section 6 in order to deform same for the pumping of liquid 2. In the depicted example, the actuation element 32 has a first actuation section 34 which is particularly embodied as a projection or raised area, and is preferably rounded off and/or protrudes toward the section 6. The first actuation section 34 preferably bears directly against the section 6 in order to (further) deform the section 6 upon actuation of the actuation element 32.

It should be noted that FIG. 1 shows the pump 1 in the non-actuated state, which is to say with unactuated or non-depressed actuation element 32. The actuation element 32 is therefore located here in its upper position. In the depicted example, the section 6 is preferably already deformed or pressed in this non-actuated state by the actuation section 34, i.e. particularly toward the bottom section 25 of the pump chamber 8. As a result, the preferred pretensioning of the section 6 is achieved into the non-actuated position and in the non-actuated position of the pump 1. Particularly, as a result of the elastic restorative forces and the pretensioning of the section 6, a separate restorative means for the actuation element 32, such as a return spring, can be omitted. In the depicted example, the returning of the actuation element 32 to position or its elastic pretensioning into the non-actuated position shown in FIG. 1 is therefore preferably achieved exclusively through the restorative forces of the section 6.

The actuation element 32 can be depressed for actuation starting from the position shown in FIG. 1. This actuation is preferably performed manually. For this purpose, the actuation element 32 has, particularly, a handle or a support area 35 which a user (not shown) can influence particularly with one finger or several fingers for the actuation or swiveling of the actuation element 32.

The handle or the support area 35 is preferably embodied in a single piece with the actuation element 32 or formed by same. However, other constructive solutions are also possible.

The actuation element 32 preferably encloses or surrounds the outlet area 21 or the nozzle 22 of the pump 1. In particular, the actuation element 32 has an opening 36 through which the outlet area 21 or the nozzle 22 or an outlet of the pump 1 extends. Especially preferably, the opening 36 is arranged between the support area 35 and an upper end of the pump 1 or of the actuation element 32. The opening 36 is preferably oblong, slit-like or oval in order to make the desired depression or swiveling of the actuation element possible.

The opening 36 can also act simultaneously as a swivel limit for the actuation element 32. In the depicted example, the opening 36 limits the swiveling of the actuation element 32 upward, so that the actuation element 32 is held in or limited to a defined non-actuated position in which the section 6 is elastically pretensioned. The elastic restorative forces of the section 6 would therefore swivel the actuation element 32 further upward. The (in the depicted example) lower edge of the opening 36 limits a further swiveling of the actuation element 32 upward through abutnent against the first component 4 or outlet area 21 or against another part of the pump 1.

The swivel axis 33 is preferably arranged on the side of the pump 1 or of the pump chamber 8 opposite the outlet or outlet area 21 or the nozzle 22.

Preferably, the swivel axis 33 is substantially at the same level or below the outlet area 21 or of the nozzle 22 or of another outlet of the pump 1.

The actuation element 32 is preferably mounted in a pivotable manner from the first component 4 or lower part. The actuation element 32 can preferably be connected with the pump 1 or the first component 4 through snapping-on in a hinged manner.

The actuation element 32 is preferably pivoted via two axially spaced bearings—i.e. bearings staggered along the swivel axis 33. This leads to support which is as stable as possible with particularly little cost of materials.

In the depicted example, the actuation element 32 preferably has one, particularly two molded bearing sections 37 with bearing lugs 38 which can be engaged particularly in a locking manner with one or two bearing bolts 39 formed on the component 4, particularly through appropriate lead-in chambers and/or axial rebounding of the bearing sections 37 upon snapping-on of the actuation element 32. However, other constructive solutions are also possible here.

The pump 1 preferably has a lock 40 for locking the actuation of the actuation element 32.

The lock 40 preferably has a locking element 41 which is manually swivelable and/or molded on a housing part or the first component of the pump 1. The locking element 41 is particularly connected via a film hinge 42 with the first component 4, particularly in the outlet area 21 or in the area of the opening 36 or with another part of the pump 1.

FIG. 1 shows the unlocked position. The locking element 41 is swiveled forward and does not impede or block a swiveling of the actuation element 32. In the locked state indicated with broken lines, the locking element 41 engages—in the depicted example, with its free end—into the opening 36 in or on its preferably upper edge in such a manner that the actuation or the swiveling of the actuation element 32 is locked downward or blocked from the non-actuated position shown in FIG. 1 into a depressed position. However, other constructive solutions are also possible here.

It is also possible for the lock 40 or its locking element 41 to be used simultaneously to cover the nozzle 22 or another outlet of the pump 1 in the locked state or for it to bring about such a covering.

Alternatively, the lock 40 or its locking element 41 can also act on another area or part of the actuation element 32.

Alternatively, the locking element 41 can also be supported on the actuation element 32 and act in the locked state on the first component 4 or lower part or another part of the pump 1.

In the unlocked state, the actuation element 32 is preferably manually operable, particularly depressible or swivelable.

In the depicted example, upon actuation, the actuation element 32 is swiveled downward from the position shown in FIG. 1, namely about the swivel axis 33. In this, the first actuation section 34 presses on the section 6 and deforms this into the pump chamber 8 or toward the first component 4 or bottom section 25. Consequently, the volume of the pump chamber 8 is reduced, and liquid 2 located in the pump chamber 8 is forced from the pump chamber 8 and dispensed via the outlet valve 10 and the nozzle 22. In particular, the liquid 2 flows through the connection channel 18 and the ring channel 19 to the outlet valve 10, which opens automatically as a result of the (increasing) liquid pressure. The liquid 2 then flows further via the outlet channel 20 to the nozzle 22, over which the liquid 2 is then particularly atomized or sprayed and, especially preferably, dispensed in the form of a spray mist.

Upon completion of the actuation or corresponding drop in the liquid pressure in the pump chamber 8, the outlet valve 10 closes again preferably automatically, particularly as a result of commensurate restorative forces, here of the retaining section 16.

Due to the inherent elasticity or restorative force of the section 6, a preferably automatic return into the initial position shown in FIG. 1 occurs upon release of the actuation element 32, with new liquid 2 being removed, particularly sucked, via the inlet valve 9 into the pump chamber 8. The opening of the inlet valve 9 during the return to position preferably occurs automatically due to the negative pressure present in the pump chamber 8. The sucking of the liquid 2 from the container 3 occurs here particularly via the suction line 26 and the connector 24.

Upon opening of the inlet valve 9, the actuation element 32 slides down onto the valve flap 11. The valve flap 11 lifts from the inlet opening 12 in order to release it.

Upon completion of the intake stroke or return to position of the section 6 into the initial position shown in FIG. 1, the sucking of liquid 2 from the container 3 is terminated. The inlet valve 9 then closes again, preferably automatically. Especially preferably, the closing of the valve flap 11 as a result of restorative forces or commensurate pretensioning into its closed position is supported by the only optionally provided pretensioning element 13 pretensioned into the closed position or acting on the valve flap 11.

Figure 4:
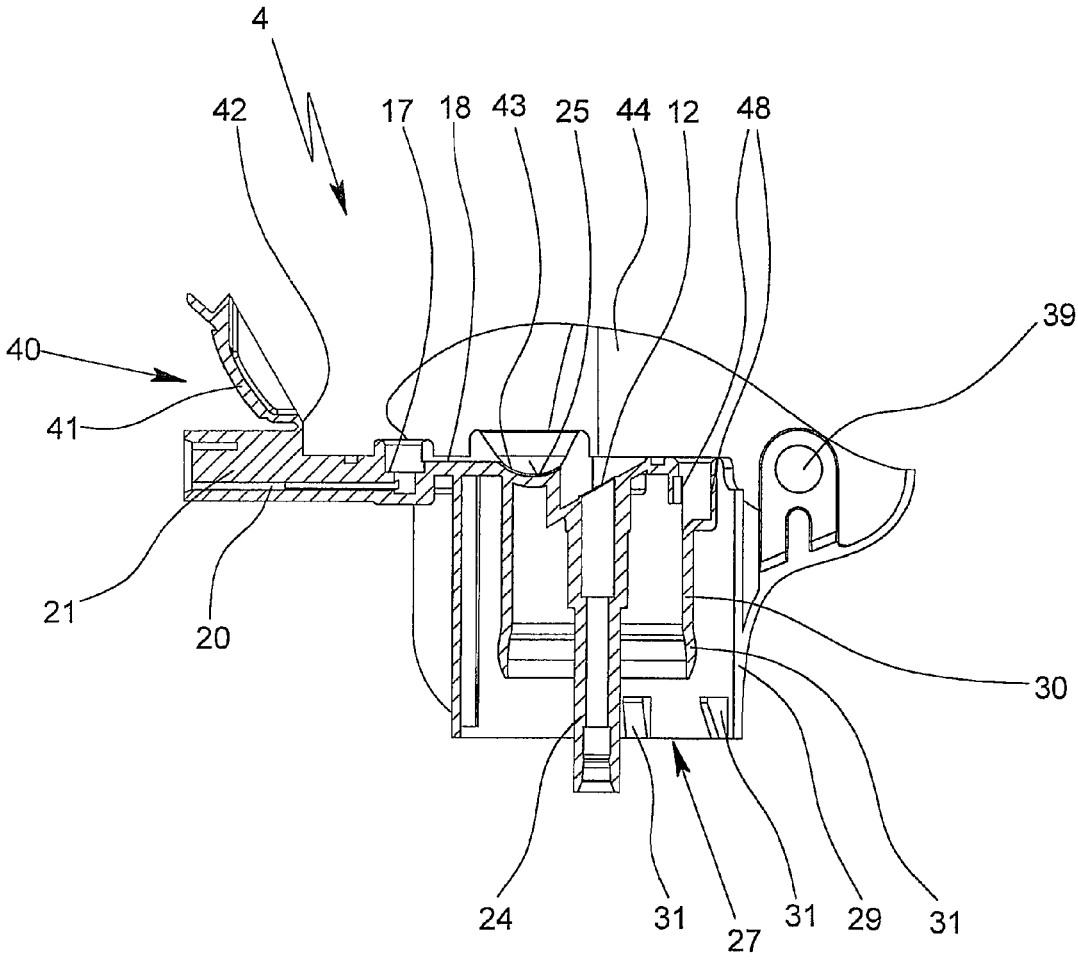
FIG. 4 shows a schematic section of a base part of the pump.

To facilitate the ventilation of the pump 1 or of the pump chamber 8 and/or to better canalize the flow of the liquid 2, particularly at higher viscosity, and/or to facilitate the return to position of the section 6 starting from the position pressed against the bottom section 25, the bottom section 25 preferably has a channel 43 as indicated schematically in the schematic sectional representation of the lower component 4 or lower part according to FIG. 4. The channel 43 thus preferably forms a ventilation channel. The channel 43 is particularly groove-like and/or leads to an outlet or to the outlet valve 10 or to the connection channel 18. In particular, the channel 43 runs at least substantially in the outlet direction and/or in the direction of circulation of liquid 2 through the pump chamber 8.

The pump 1 has an outer housing which is at least substantially closed or closed for the most part, or an at least substantially smooth or closed outer contour. The outer contour or the outer housing is preferably formed by the actuation element 32.

Particularly, the actuation element 32 forms an upper covering or an upper housing area or the upper end of the pump 1.

The pump 1 or the first component or lower part 4 preferably forms a housing, particularly outer housing of the pump 1, and/or the pump 1 preferably has two opposing or spaced side screens 44 particularly at the upper or free end of the pump 1 which cover the actuation element 32 in part and/or laterally and/or form with the actuation element 32 an at least extensively closed outer housing of the pump 1 and/or an upper covering of the pump 1. Especially preferably, the actuation element 32 can be moved between the two side screens 44 at least with a lower side or edge area.

However, other constructive solutions are also possible. For example, the actuation element 32 can also cover the side screens 44 and/or the other outer housing of the pump 1 from above and/or laterally.

The pump 1 preferably has a ventilation valve 45 for the container 3. The ventilation valve 45 is preferably formed by the first and/or second component 4, 5.

The ventilation valve 45 preferably has a movable ventilation valve body 46 and, optionally, an associated retaining section 47. Especially preferably, the retaining section 47 keeps the ventilation valve body 46 movable and/or pretensioned in a closed position against a ventilation valve seat 48.

The ventilation valve body 46 and the optional retaining section 47 are preferably formed by the second component 5 or upper part, particularly made of the soft plastic and/or embodied in a single piece with the section 6.

In the depicted example, the preferably bolt-shaped, cylindrical or oblong ventilation valve body has, especially preferably, an oblong or hollow and cylindrical jacket 49 made of the soft plastic and a core 50 made of another material, for example the material of the rigid section 14. However, other constructive solutions are also possible here.

The ventilation valve body 46 is preferably seated with a free or circumferential edge made of the relatively soft or deformable material or the jacket 49 on the associated ventilation valve seat 48.

The ventilation valve seat 48 is preferably formed in the first component or lower part 4 and/or is at least substantially hollow and cylindrical.

Through corresponding, here substantially axial, displacement of the ventilation valve body 46, the ventilation valve 45 can be opened and closed, so that a connection of the container 3 or of the inner space (gas space) of the container 3 with the atmosphere can be appropriately opened and closed.

The ventilation valve 45 is preferably pretensioned into its closed position or closes automatically, particularly as a result of the elastically deformable retaining section 47, which is particularly already deformed in the assembled state. However, other constructive solutions are also possible.

The ventilation valve 45 is preferably forceably opened upon deformation of the section 6 or actuation of the pump 1 or upon actuation of the actuation element 32. Especially preferably, the actuation element 32 opens the ventilation valve 45 automatically upon actuation of the actuation element 32, particularly through a second actuation section 51 of the actuation element 32 which presses or pushes the ventilation valve body 46 into the open position upon actuation of the actuation element 32, for example.

The forced opening of the ventilation valve 45 leads to the advantage that a defined opening and closing can be achieved. Particularly, upon sucking of liquid 2 from the container 3, pressure loss is prevented which could result from air subsequently flowing into the container 3 having to first open a valve. Accordingly, a quick return of the section 6 into the non-actuated initial position is thus supported upon sucking.

The proposed pump 1 preferably has three valves, i.e. the inlet valve 9, the outlet valve 10 and the ventilation valve 45, all of which are preferably formed by the upper part and/or lower part.

The pump 1 is preferably manufactured exclusively from plastic, particularly at least substantially (with the exception of the suction line 26) from injection-molded parts.

The pump 1 is preferably constructed from fewer than ten, particularly from at most five components, in the depicted example particularly only from the actuation element 32, the lower part 4 for supporting the actuation element 32, the upper part 5 forming the section 6, the nozzle insert 21 and/or the suction line 26.

The rigid section 14 is preferably manufactured from the same material or a similar material as the lower part 4.

The soft plastic which forms the section 6 and particularly the edge 7, the outlet valve body 15, the retaining section 16, the valve flap 11, the pretensioning element 13, the retaining section 47 and/or the jacket 49 as well, very especially preferably through embodiment in a single piece or single-piece injection molding, is preferably a thermoplastic silicon or another suitable material which can be joined especially by bi-injection with the rigid section 14 in a solid and/or tight manner.

Individual features and aspects of the described pump or of the present invention can also be implemented independently of each other and/or in any combination.

LIST OF REFERENCE SYMBOLS

1 Pump
2 Liquid
3 Container
4 First component
5 Second component
6 Section
7 Edge
8 Pump chamber
9 Intel valve
10 Outlet valve
11 Valve flap
12 Inlet opening
13 Prctcnsiontng element
14 Rigid section
15 Outlet valve body
16 Retaining section
17 Outlet valve seat
18 Connection channel
19 Ring channel
20 Outlet channel
21 Outlet area
22 Nozzle
23 Nozzle insert
24 Connector
25 Bottom section
26 Section line
27 Connection device
28 Edge/collar
29 Cylinder section
30 Retaining area
31 Projection
34 First actuation section
35 Support area
36 Opening
37 Bearing section
38 Bearing lug
39 Bearing bolt
40 Lock
41 Locking element
42 Film hinge
43 Channel
44 Side screen
45 Ventilation valve
46 Ventilation valve body
47 Retention section
48 Ventilation valve seat
49 Jacket

50 Core
51 Second actuation section
32 Actuation element
33 Swivel axis

The invention claimed is:

1. A pump that dispenses a liquid comprising: an elastic or flexible section which can be deformed for the pumping of the liquid, with the pump having a manually operable actuation element to deform the section for pumping, wherein the actuation element has an opening for an outlet or outlet area of the pump, wherein the pump has a lock for locking the actuation of the actuation element, wherein the lock has a locking element which is manually swivelable and is molded onto a lower housing part of the pump, wherein the locking element is connected with the lower housing part via a film hinge and wherein the locking element acts on the edge of the opening in such a manner that the actuation or the swivelling of the actuation element is locked.

2. The pump as set forth in claim 1, wherein a swivel axis of the actuation element is parallel to a swivel axis of the locking element.

3. The pump as set forth in claim 1 wherein the locking element is moveable upwards into a locked position.

4. The pump as set forth in claim 1, wherein the actuation element can be swiveled for actuation on a fixed swivel axis.

5. The pump as set forth in claim 1, wherein the pump has a component or housing part, particularly a component forming the outer housing of the pump with side screens, which cover the actuation element in part or laterally or form with the actuation element an at least extensively closed outer housing of the pump.

6. The pump as set forth in claim 1, wherein the actuation element is limited in its path of movement such that, in the non-actuated state, it pretensions or deforms or presses-in the section.

7. The pump as set forth in claim 1, wherein the liquid is a cosmetic liquid.

8. The pump as set forth in claim 1, wherein the pump is constructed from fewer than ten components.

9. The pump as set forth in claim 8, wherein the pump is constructed from at most five components, including the actuation element, the lower housing for supporting the actuation element, a component or upper part forming the section, a nozzle insert and a suction line.

10. The pump as set forth in claim 9, wherein the upper part together with the lower part, forms the ventilation valve, the inlet valve or an outlet valve.

11. The pump as set forth in claim 1, wherein the liquid can be pumped or conveyed through reversible deformation of the section and can be dispensed from a pump chamber formed or bordered by the section and via an outlet valve and the liquid can be subsequently removed, and sucked into the pump chamber via an inlet valve as a result of an automatic elastic returning to position of the section.

12. The pump as set forth in claim 1, wherein the pump has a pump chamber with a bottom section against which the section can be deformed, with a particularly groove-like channel leading to an outlet or running in the outlet direction being formed in the bottom section.

13. The pump as set forth in claim 1, wherein the section is substantially calotte-like, dome-like or arched.

14. The pump as set forth in claim 1, wherein the pump is adapted to snap onto an associated container.

15. The pump as set forth in claim 1, wherein the pump is associated with a container with the liquid.

16. The pump as set forth in claim 15, wherein the pump is undetachable or detachably joined with the container.

17. The pump as set forth in claim 1, wherein the pump is manufactured exclusively of plastic, particularly at least substantially only of injection-molded parts.

* * * * *